US006190199B1

(12) United States Patent
Bump et al.

(10) Patent No.: US 6,190,199 B1
(45) Date of Patent: Feb. 20, 2001

(54) POWER ADAPTER MOUNTING ASSEMBLY

(75) Inventors: Joel G. Bump, Prescott, AZ (US); Hugh T. Wilcox, Camarillo, CA (US)

(73) Assignee: Clump Corporation, Carpenteria, CA (US)

( * ) Notice: Under 35 U.S.C. 154(b), the term of this patent shall be extended for 0 days.

(21) Appl. No.: 09/287,725

(22) Filed: Apr. 7, 1999

(51) Int. Cl.[7] ..... H01R 13/60; H01R 13/66
(52) U.S. Cl. ..... 439/540.1; 439/502
(58) Field of Search ..... 439/540.1, 716, 439/532, 650, 653, 214, 574, 371, 651, 652, 719, 502

(56) References Cited

U.S. PATENT DOCUMENTS 5,603,628 * 2/1997 Schapiro, Jr. ..... 439/327
5,984,720 * 11/1999 Milner et al. ..... 439/534
6,024,588 * 2/2000 Hsu et al. ..... 439/173

* cited by examiner

*Primary Examiner*—Neil Abrams
*Assistant Examiner*—Michael C. Zarroli
(74) *Attorney, Agent, or Firm*—Elliott N. Kramsky

(57) ABSTRACT

Apparatus for operatively coupling a plurality of electronic devices each being of the type that includes a plug-in power adapter to an a.c. power supply. A power strip is plugged into an a.c. outlet. The power strip includes a plurality of female receptacles longitudinally aligned at a surface of an elongated housing. The power adapters are fixed to an elongated surface of a bracket by means of relatively-short shuttle conductor cords. The shuttle cords are interconnecting, at their opposed ends, to the receptacles of the power strip and the male plugs of the power adapters which are held in place, adjacent one another, affixed to the surface of an elongated bracket.

13 Claims, 1 Drawing Sheet

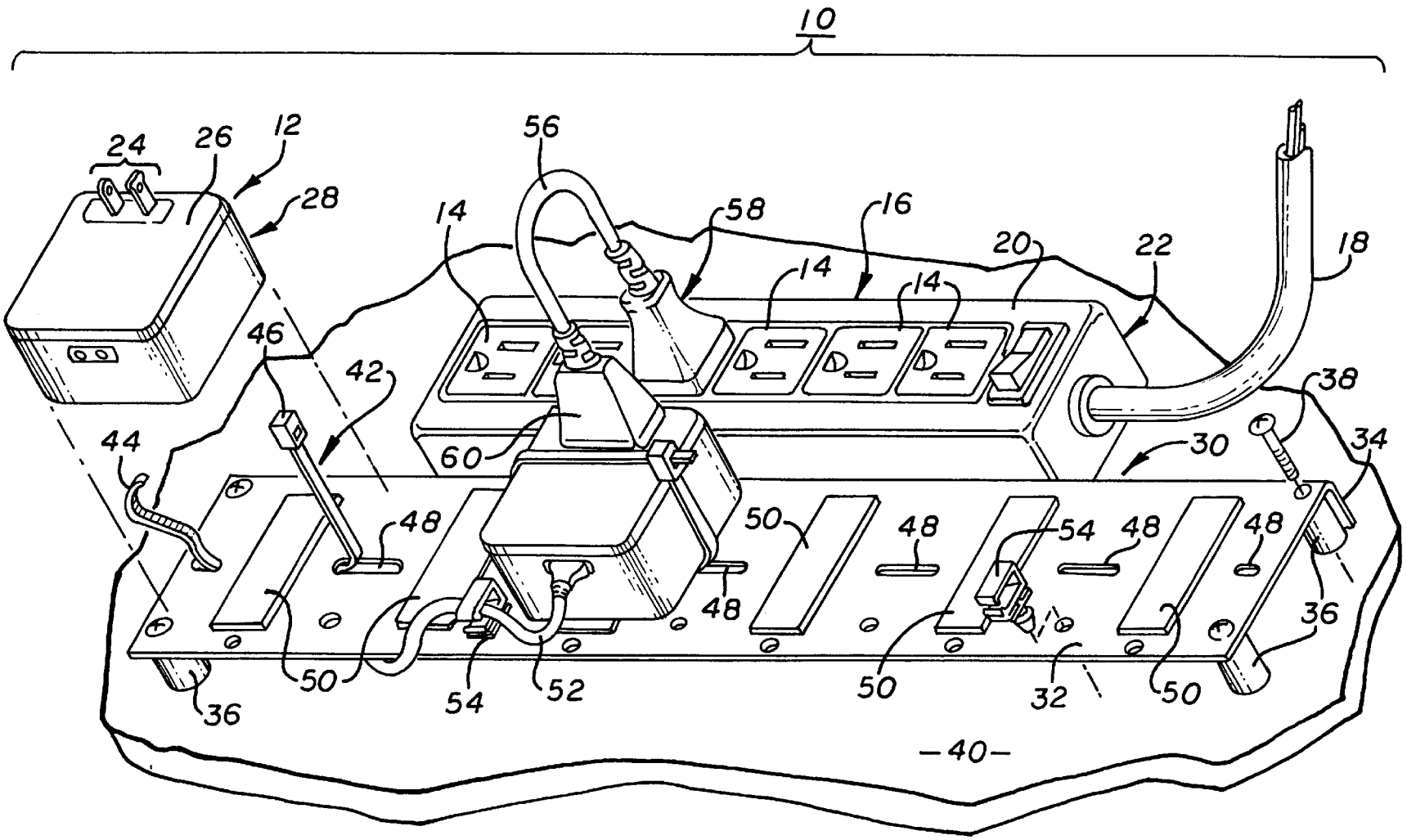
10
12
14
16
18
20
22
24
26
28
30
32
34
36
38
40
42
44
46
48
50
52
54
56
58
60

POWER ADAPTER MOUNTING ASSEMBLY

BACKGROUND

1. Field of the Invention

The present invention relates to interconnections for coupling electronic and electrical devices to output power. More specifically, this invention pertains to apparatus for facilitating full utilization of a conventional power strip by multiple plug-in power adapters.

2. Description of the Prior Art

The emergence of numerous electronic devices as common features of today's environment, whether the office, industry or the home, is well recognized. Common ancillary support devices often associated with the use of electronics apparatus include the "power strip" that consists of a plurality of female plug receptacles aligned longitudinally about a surface of a generally-rectangular housing and the box-like plug-in power adapter that is commonly fixed at the remote end of a conductor coupled to the device. (Note: By separating the power adapter from the electronic device, one forgoes the necessity of UL certification as well as that of equivalent non-U.S. organizations such as CSA (Canada) and CE (Europe), of the device.)

The above-mentioned ancillary devices may perform a number of functions as required by the associated electronics, including voltage step-down, rectification, surge protection and the like. Regardless of the particular functions offered, there exists an inherent incompatibility between the physical structures of common power strips and plug-in power adapters. The receptacles of a power strip function as remote sockets for plugging into the a.c. power main or source. Generally, however, the distances between adjacent female plug receptacles of conventional power strips are insufficient to permit one to plug power adapters into adjacent power strip receptacles. As a result, one can make use of only a fraction of the receptacles of a single power strip when connecting a plurality of plug-in adapters. This can greatly complicate certain applications and arrangements such as those involving numerous electronic modules located within a conventional equipment rack. Solutions such as the use of customized power strips (with increased, non-standard receptacle-to-receptacle spacings) or multiple, partially-utilized power strips of conventional design can be costly and involve the undue consumption of precious space in such applications as airborne electronics as well as fixed installations subject to high land and construction costs.

SUMMARY OF THE INVENTION

The present invention addresses the foregoing problems of the prior art by providing apparatus for operatively coupling at least one device of the type that includes an associated plug-in power adapter to an a.c. power outlet. Such apparatus includes a power strip of the type that includes a plurality of female receptacles aligned along a surface of a strip housing.

A bracket is provided. Means are provided for affixing the power adapters to the bracket. A shuttle conductor cord has a male plug and a female receptacle affixed to its opposed ends with the male plug of the cord coupled to a receptacle of the power strip and the female receptacle of the cord coupled to the male plug of the power adapter.

The preceding and other features and advantages of the present invention will become further apparent from the detailed description that follows. Such description is accompanied by a set of drawing figures in which numerals, corresponding to numerals of the written description, point to the features of the invention. Like numerals refer to like features of the invention throughout both the drawing figures and the written description.

BRIEF DESCRIPTION OF THE DRAWING FIGURES

The FIGURE is a partially-exploded perspective view of the invention.

DETAILED DESCRIPTION OF THE PREFERRED EMBODIMENT

Turning now to the drawings, the FIGURE is a partially-exploded perspective view of the invention. The invention 10 provides a means for positioning a plurality of plug-in power adapters 12, each being of the type that is commonly associated with an electronic device, modular or otherwise (e.g. computer, modem, fax machine, telephone answering machine) to simultaneously engage a female receptacle 14 of a conventional power strip 16. Such a power strip is arranged to plug into an a.c. main or power source and to communicate therewith by means of a power cord 18.

A plurality of female receptacle plugs 14 is longitudinally aligned at the top surface 20 of a power strip housing 22. In addition to providing a multiplicity of receptacles 14 for communicating with a corresponding plurality of electronic devices (not shown), the power strip 16 may be enabled by an on-line power surge to protect the plugged-in devices in various ways.

As mentioned earlier, a plug-in power adapter 12 may provide a number of functions to achieve compatibility between an electronic device and the a.c. power source. Characteristically, a power adapter 12 is arranged to plug into either a wall outlet or a receptacle 14 of a power strip 16. Accordingly, a pair of pins 24 forms a male plug that projects from a surface of the casing 28 of the plug-in power adapter 12.

Typically, the casing 28 of a plug-in power adapter 12 is of such size that it is not possible to insert adapters into adjacent receptacles 14 of the power strip 16. As a result, one must either employ multiple power strips or a strip of special design with appropriate inter-receptacle spacing. Either of such solutions wastes often-limited space. For example, current worldwide standards dictate sizes of equipment racks for such diverse systems as those employed in aircraft, submarines, radio stations and the like. The shelves of such racks are specified to be nineteen (19) inches in width and their heights are between eighteen (18) inches and eight feet. The heights of electronic modules are calibrated in "rack units" where a rack unit equals 1-⅞ inches. Thus, exceeding large numbers of electronic modules may packed into a conventional equipment rack, with each module having an associated plug-in power adapter. It is therefore essential that arrangements for supplying power to such modules be as compact as possible.

In the invention, a bracket 30 is provided that permits multiple power adapters 12 to be fixed adjacent one another with appropriate spacing. The bracket 30, suitable for mounting to a standard equipment rack (not shown), includes a planar, generally rectangular and elongated surface 32 of sheet metal. An edge flange 34 adds rigidity to the surface 32. Cylindrical legs 36 accommodate drywall screws 38 or like elongated fasteners for mounting the bracket to a panel 40 such as an element of an equipment rack.

Means are provided for fixing a plurality of power adapters 12 to the bracket 30. Such means includes a flexible tie 42 of the type that includes interlockable end members 44, 46. Elongated slots or apertures 48 within the surface 32 are provided for threading the flexible ties 42 so that, by interlocking of the end members a power adapter 12 is fixed to the bracket 30 as shown. Double-sided adhesive strips 50 are located between adjacent slots to provide additional means for affixing the power adapters to the bracket 30. By providing redundant mechanisms for fixation of the plug-in power adapters to the bracket, one need not be concerned that aging of the adhesive material will dislodge the power adapter from the bracket. As an alternative, the strips 50 (and like strips located correspondingly at the bottom surface of the power adapters) may include opposed surfaces of adhesive and a hook-like material such as that marketed by Minnesota Mining and Manufacturing Corporation under the trademark "DUAL-LOK". When such an alternative material is utilized, the adhesive surfaces interface and thereby stick to, the bottom of the adapter and the surface 32 of the bracket 30. The adapter is held to the bracket 30 by interlocking of the facing DUAL-LOK surfaces.

Once the power adapter 12 is affixed to the bracket 30, the cord 52 connecting it to the modular electronic device may be captured by a c-clip 54 fixed to the surface 32. The provision of a clip 54 is particularly useful in the event that a large plurality of electronic modules are to be employed within a confined space such as an equipment rack. Such clips serve to minimize the possibility of wiring errors throughout the system and may be employed in lieu of complex wiring harnesses.

A relatively-short shuttle conductor cord 56 whose opposed ends terminate in a male plug 58 and a female receptacle 60 bridges the distance between the power strip 16 and the bracket-mounted power adapter 12. Electrical connection between the power adapter 12 and the a.c. outlet to which the power strip 16 is connected through the cord 18 is obtained through the simultaneous insertions of the male plug 58 into a receptacle 14 of the power strip 16 and coupling of the receptacle 60 to the pins 24 of the power supply 12.

Thus it is seen that the present invention provides apparatus for operatively coupling a plurality of relatively-bulky plug-in power adapters to the closely-spaced receptacles of a power strip. In this way, an arrangement of elements that is commonly encountered in home, industry and office environments may be accomplished with minimal waste of available receptacles and without requiring undue consumption of available space or costly custom elements.

While this invention has been disclosed with reference to its presently preferred embodiment, it is not limited thereto. Rather, the present invention is limited only insofar as it is defined by the following set of patent claims and includes within its scope all equivalents thereof.

What is claimed is:

1. Apparatus for operatively coupling at least one electronic device of the type that includes an associated plug-in power adapter to an a.c. power outlet comprising, in combination:

a) a power strip, said strip including a plurality of female receptacles aligned along a surface of a strip housing;

b) a bracket;

c) means for affixing said power adapter to said bracket;

d) a shuttle conductor cord having a female receptacle and a male plug affixed to its opposed ends; and e) said male plug of said cord being coupled to a receptacle of said power strip and said female receptacle of said cord being coupled to said male plug of said power adapter.

2. Apparatus as defined in claim 1 wherein said means for affixing includes an elongated tie having interlockable opposed end members.

3. Apparatus as defined in claim 2 further including apertures within said bracket arranged to receive said tie.

4. Apparatus as defined in claim 3 further including:

a) said bracket comprising a generally-elongated rectangular surface; and b) a plurality of apertures aligned along a major axis of said surface.

5. Apparatus as defined in claim 4 further including:

a) means for adhesively fixing a power adapter to said bracket; and b) said means for adhesively fixing being located at said surface intermediate adjacent pairs of aligned apertures.

6. Apparatus as defined in claim 5 wherein said means for adhesively fixing comprises a strip having opposed adhesive surfaces.

7. Apparatus as defined in claim 5 wherein said means for adhesively fixing comprises a strip having opposed surfaces of adhesive and hook-like materials.

8. Apparatus as defined in claim 5 further including at least one guide clip fixed to said bracket.

9. Apparatus as defined in claim 8 wherein said guide clip includes a generally c-shaped section for receiving a conductor.

10. Apparatus as defined in claim 4 further characterized in that:

a) said apertures are of elongated shape; and b) said apertures are arranged so that their major axes are aligned with the major axis of said generally-rectangular surface of said bracket.

11. Apparatus as defined in claim 1 wherein said bracket further includes:

a) a generally-rectangular major planar member; and b) means for spacing said member from a mounting surface.

12. Apparatus as defined in claim 11 wherein said means for spacing further includes:

a) an edge member; and b) said edge members being or progenal to said surface.

13. Apparatus as defined in claim 11 wherein said means for spacing includes a plurality of feet affixed orthogonal to said surface.

* * * * *